United States Patent [19]

Mundus et al.

[11] 4,433,599

[45] Feb. 28, 1984

[54] APPARATUS FOR FORMING AND STACKING SECTIONS SEVERED FROM A WEB OF TUBULAR FILM

[75] Inventors: Friedhelm Mundus; Fritz Achelpohl, both of Lengerich, Fed. Rep. of Germany

[73] Assignee: Windmoller & Holscher, Lengerich, Fed. Rep. of Germany

[21] Appl. No.: 313,624

[22] Filed: Oct. 21, 1981

[30] Foreign Application Priority Data

Oct. 23, 1980 [DE] Fed. Rep. of Germany ..... 3040021

[51] Int. Cl.[3] ..... B31B 1/98

[52] U.S. Cl. ..... 83/87; 83/91; 83/96; 83/112; 83/152

[58] Field of Search ..... 83/87, 88, 90, 91, 92, 83/96, 112, 152; 271/180, 182, 183, 202, 203, 216, 197; 198/422, 423; 414/49, 72

[56] References Cited

U.S. PATENT DOCUMENTS 2,011,505 8/1935 Smith ..... 83/96
2,895,552 7/1959 Pomper et al. ..... 83/92
3,595,564 7/1971 DeYoung ..... 83/88 X

FOREIGN PATENT DOCUMENTS 1299515 7/1969 Fed. Rep. of Germany .
2832660 2/1980 Fed. Rep. of Germany .
2915689 10/1980 Fed. Rep. of Germany .

*Primary Examiner*—James M. Meister
*Attorney, Agent, or Firm*—Fleit, Jacobson, Cohn & Price

[57] ABSTRACT

In an apparatus for stacking sections separated from an intermittently fed web of sheet material, successive sections are held by clamping means and transferred to the upper arm of a first suction belt conveyor having suction holes which are at a spacing larger than the length of each section and attract the trailing end thereof. A second suction belt conveyor with suction holes at the same spacing overlaps the first conveyor and takes over the sections with its lower run by attracting the leading ends. An intermittently operatively stacking conveyor under the second belt conveyor has the sections deposited thereon by means for withdrawing the sections from the second belt conveyor.

4 Claims, 1 Drawing Figure

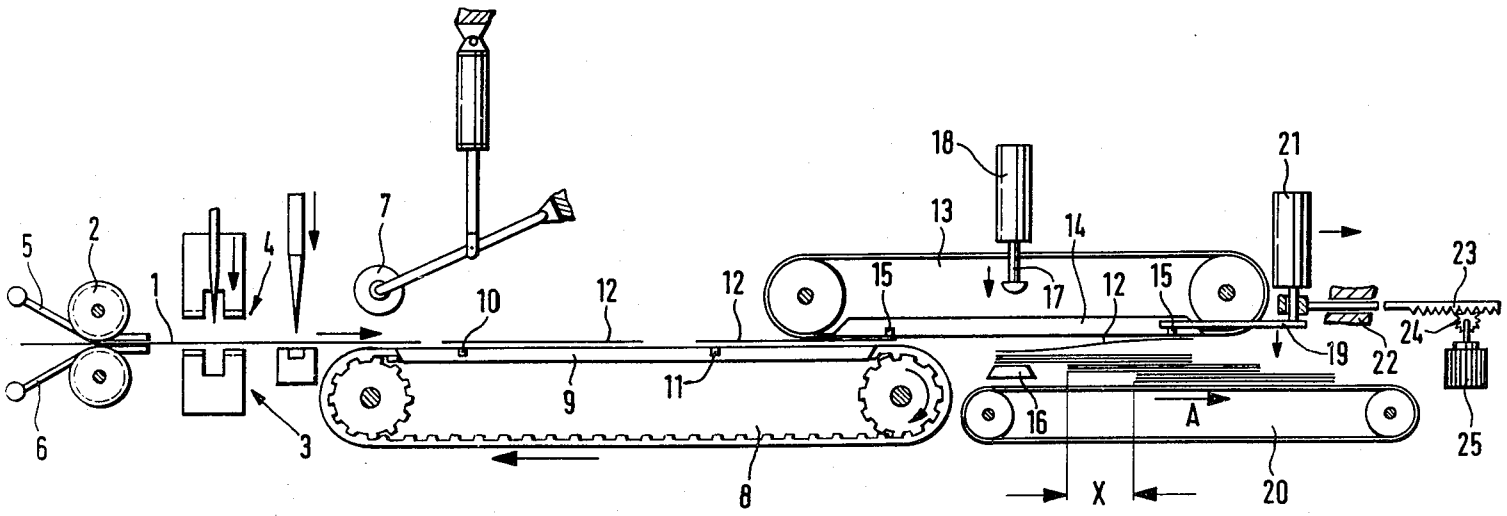
1
2
3
4
5
6
7
8
9
10
11
12
13
14
15
16
17
18
19
20
21
22
23
24
25
A
X

APPARATUS FOR FORMING AND STACKING SECTIONS SEVERED FROM A WEB OF TUBULAR FILM

The invention relates to an apparatus for forming and stacking sections severed from a web of tubular film or a web of material or weld-separated bag or sack workpieces, comprising transverse severing or welding means which sever or weld-separate sections from the intermittently advanced web of material and means for clamping each severed section, a suction belt conveyor which receives the severed sections and of which the belts are provided with suction holes at a spacing larger than the length of the sections, and a pressure roller which can be moved towards and raised off the receiving end of the suction belt conveyor in sequence with the release of the clamping means and of which the pressing-on motion is so synchronised with the passage of the suction holes that the trailing portion of each section is suction-attracted by the suction holes.

In an apparatus of this kind known from DE-OS No. 29 15 689, published Oct. 23, 1980, each section is suction-attracted by the lower run of a suction belt conveyor in the vicinity of its trailing end, the leading end of the section being held taut by a faster suction belt conveyor which rises at an acute angle to the delivery end of the upper suction belt conveyor, a drum for spiking the sections at their leading end being provided for stacking purposes behind the delivery end of both conveyors and turning at the conveying speed of the upper suction belt conveyor in sequence with the supply of the sections.

The problem of the present invention is to modify an apparatus of the known kind so that stacks can be formed from sections, particularly flimsy, sensitive and easily creasable material without piercing by successively superimposing same.

According to the invention, this problem is solved in that the suction belt conveyor which conveys with its upper run has its end portion partially covered by a second suction belt conveyor which takes over the sections and conveys same with its lower run and of which the belts are likewise provided with suction holes at a spacing corresponding to the spacing of the suction holes of the first suction belt conveyor for suction-attracting the leading portions of the sections supplied by the first suction belt conveyor, and that an intermittently driven stacking belt conveyor is provided under the second belt conveyor, on which the sections are deposited by means for withdrawing same from the second suction belt conveyor. The apparatus according to the invention permits the formation of stacks from sections, even of thin, lightweight and creasable material, because the sections are constantly held in the correct position by holding means straight after severing from the web of material, are fixed during their transport and are deposited by special withdrawal means.

DE-AS No. 12 99 515, published July 17, 1969, discloses an apparatus for stacking thin film sections in which the film sections are intermittently fed by the lower run of a suction belt conveyor over the stack being formed or over the depositing station and are there released from the suction belt by a striker during the standstill of the sections. In this known apparatus, not only is the stacking speed limited by the intermittent drive of the suction belt leading the sections to the stacking station but positionally correct fixing of the sections to the suction belt conveyor is also not ensured.

From DE-AS No. 28 32 660, published Feb. 7,1980, it is known to convey to a stacking station sections which are suction-attracted at their leading ends by the lower run of a suction belt conveyor.

Desirably, the withdrawing means comprise plungers which engage through the gap formed between the belts and press the loose trailing ends of the sections against a support, the stacking belt conveyor or the stack being formed thereon. The leading ends of the sections will then be correctly deposited on the stack after they drop off or are withdrawn from the suction holes.

The support may be a suction bar which secures the position of the first section of a stack. Desirably, in the front zone of the second suction belt conveyor there is a rake which engages through the gap, presses the last section of each stack thereon, is movable therewith during intermittent advance of the stacking belt conveyor and returns to its position of readiness after each advance. The lowerable rake fixes the stack before it is intermittently led away and results in clean separation of the last section of the last stack and the first section of the new stack to be formed.

One example of the invention will now be described in more detail with reference to the drawing in which the single FIGURE is a diagrammatic side elevation of the apparatus for forming and stacking sections.

A web 1 of tubular film coming from a supply reel (not shown) is intermittently advanced by feed rollers 2 and passed between the open jaws of welding means 3 as well as the jaws of clamping means 4. For the purpose of advancing the leading end of the web 1 of tubular film in a taut condition, there are two blow nozzles 5, 6 which produce an air jet for supporting the leading end of the web of tubular film. As soon as the web 1 has reached the position shown in the drawing, control means (not shown) terminate feeding and actuate the welding means, the jaws of the clamping means 4 being closed simultaneously. After severing a section, the welding means 3 are opened again.

Upon lowering the pressure roller 7 which is actuated by a piston-cylinder unit, the jaws of the clamping means 4 are also opened so that the section is brought into contact with the upper run of the suction belt conveyor 8 and is led away by same. The suction belt conveyor 8 consists of a plurality of juxtaposed endless conveyor belts which run over suction boxes disposed above the lower plane of the underside of the upper run. The individual conveyor belts have holes 10, 11 at a spacing larger than the largest bag length. The individual holes 10, 11 of the conveyor belts define rows of suction holes extending transversely to the conveying direction. Driving of the suction belt conveyor 8 takes place depending on the crank shaft of the welding means 3 and in such a manner that for each rotation of the crank shaft of the welding means one row of suction holes is advanced by one division. The apparatus is so controlled that the pressure roller 7 is lowered onto the section with simultaneous opening of the clamping means 4 at an instant when the distance of the pressure roller 7 from the trailing end of the section corresponds to the distance to the next row of suction holes, so that the trailing end of the section is brought into registry with this row of suction holes. In this way only the rear end of the section 12 lying on the suction belt conveyor 8 is retained at any one time whilst the remaining portion of the section 12 lies freely on the suction belt conveyor 8. The delivery end of the suction belt conveyor 8 is overlapped by the lower run of a second suction belt conveyor 13 which likewise comprises a plurality of juxtaposed narrow endless belts.

The belts of the lower run likewise pass over suction boxes 4. As in the case of the suction belt conveyor 8, the belts of the second suction belt conveyor 13 are also provided with rows 15 of suction holes having a spacing corresponding to those of the suction belt conveyor 8. The rows of suction holes of the two suction belt conveyors 8, 13 are so adapted to each other that the rows 15 suction-attract the leading ends of the sections 12 conveyed on the suction belt conveyor 8. In this way the sections 12 are held by rows of suction holes at their leading as well as trailing ends. After the section 12 has been released from the row 11 or 12 of suction holes during further transport by the suction belt conveyor 13, it is fed by the row 15 of suction holes in a freely suspended condition until the section 12 is disposed above the stack to be formed. In this position, the trailing end of the section 12 is disposed above a suction bar 16. As soon as the section 12 has reached this position, the plungers 17 of a depressing striker 18 are extended, engaged between the belts of the suction belt conveyor 13 and push the trailing end of the section 12 onto the suction bar 16 or the stack just being formed. By reason of the fact that the section 12 is held at its trailing end by the plungers 17, the leading end of the section 12 is stripped from the row 15 of suction holes. After such depositing of section 12, the plunger 17 is retracted again.

Beneath the suction bar 16 there is a stacking belt conveyor 20 on which stacking takes place. When a stack has been formed with the desired number of sections, a pronged rake 19 disposed in the vicinity of the delivery end of the suction belt conveyor 13 is lowered and presses the formed stack onto the stacking belt conveyor 20. The pronged rake 19 is moved along at the same conveying speed with which the stacking belt conveyor 20 intermittently feeds the last stack that was formed through the distance x in the direction of the arrow A. For this purpose, the lowering cylinder 21 of the pronged rake 19 is mounted in a bracket which in turn is secured to a guide 22 having a rack 23 at its end. The rack 23 is in mesh with a pinion 24 of an electric motor 25 which at the same time serves as an intermittent drive for the stacking belt conveyor 20.

After the stacking belt conveyor 20 has advanced the stacks through the distance x in the direction of the arrow A, it is switched off again, the cylinder 21 is retracted and the rake is returned to its starting position from the position shown in the drawing.

During operation of the stacking belt conveyor 20, the suction belt conveyor 13 has already again fed sections 12 and press same onto the suction bar 16 by means of the plungers 17. The suction bar 16 retains the first bag deposited thereon so that on the one hand the first stack held by the suction bar 16 is smoothed by the stack of bags to be discharged and on the other hand the sections newly deposited on the suction bar 16 will not slip.

When the size is changed, it is merely necessary to set the rows of suction holes of the suction belt conveyors 8 and 13 to the new size by turning the belts.

We claim:

1. Apparatus for forming stacks from sections severed from a web of tubular film or a web of material or weld-separated bag or sack workpieces, comprising transverse means for severing sections from the intermittently advanced web of material and means for clamping each severed section, a suction belt conveyor which receives the severed sections and said belts are provided with suction holes at a spacing larger than the length of the sections, and a pressure roller which can be moved towards and raised off the receiving end of the suction belt conveyor in sequence with the release of the clamping means and the pressing-on motion is so synchronised with the passage of the suction holes that the trailing portion of each section is suction-attracted by the suction holes, characterised in that the suction belt conveyor which conveys with its upper run has its end portion partially covered by a second suction belt conveyor which takes over the sections and conveys same with its lower run and the belts are likewise provided with suction holes at a spacing corresponding to the spacing of the suction holes of the first suction belt conveyor for suction-attracting the leading portions of the sections supplied by the first suction belt conveyor, and an intermittently driven stacking belt conveyor is provided under the second suction belt conveyor, on which the sections are deposited by means for withdrawing same from the second belt conveyor.

2. Apparatus according to claim 1, characterised in that the withdrawing means comprise plungers which engage the sections through a gap formed between the stacking belt conveyor and the second suction belt conveyor and press the loose trailing ends of the sections against at least one of a support, the stacking belt conveyor and the stack being formed thereon.

3. Apparatus according to claim 2, characterised in that the support is a suction bar.

4. Apparatus according to one of claims 1 to 3, characterised in that in the front zone of the second suction belt conveyor there is a rake which engages and presses the last section of each stack thereon, is movable therewith during intermittent advance of the stacking belt conveyor and returns to its position of readiness after each advance.

* * * * *